United States Patent [19]

Mezger et al.

[11] Patent Number: 5,038,478

[45] Date of Patent: Aug. 13, 1991

[54] PARING KNIFE

[75] Inventors: Dieter Mezger, Gueglingen; Georg Harsch, Tamm, both of Fed. Rep. of Germany

[73] Assignee: C. & E. Fein GmbH & Co., Fed. Rep. of Germany

[21] Appl. No.: 557,384

[22] Filed: Jul. 24, 1990

[30] Foreign Application Priority Data

Aug. 15, 1989 [DE] Fed. Rep. of Germany ..... 3926862
Sep. 8, 1989 [DE] Fed. Rep. of Germany ..... 3929852

[51] Int. Cl.[5] ..... B26B 7/00

[52] U.S. Cl. ..... 30/272.1; 30/169; 30/294; 30/314

[58] Field of Search ..... 30/169, 172, 299, 300, 30/272.1, 239, 294, 314; 15/236.01, 236.02, 236.05

[56] References Cited

U.S. PATENT DOCUMENTS

| | | | |
|---|---|---|---|
| 519,250 | 5/1894 | Fearn . | |
| 1,480,053 | 1/1924 | Ericsson | 30/169 |
| 2,681,502 | 6/1954 | Black . | |
| 3,091,852 | 6/1963 | DeLarber | 30/172 |
| 3,448,517 | 6/1969 | Cothery . | |
| 3,530,577 | 9/1970 | Franklin et al. | 30/169 |
| 3,613,134 | 10/1971 | Bassett . | |
| 3,791,014 | 2/1974 | Perna | 30/294 |
| 3,924,327 | 12/1975 | Edwards | 30/277 |
| 3,990,144 | 11/1976 | Schwartz | 30/123 |
| 4,080,734 | 3/1978 | Barbour | 30/123 |
| 4,199,852 | 4/1980 | Ayers et al. | 29/239 |
| 4,215,475 | 8/1980 | Morford et al. | 30/272 R |
| 4,543,720 | 10/1985 | Grunikiewicz et al. | 30/272 R |
| 4,700,478 | 10/1987 | Mezger et al. | 30/294 |
| 4,989,320 | 2/1991 | Borkott et al. | 30/272.1 |

FOREIGN PATENT DOCUMENTS

| | | | |
|---|---|---|---|
| 141035 | 3/1987 | European Pat. Off. . | |
| 514099 | 12/1929 | Fed. Rep. of Germany | 15/236.05 |
| 7623976 | 12/1976 | Fed. Rep. of Germany . | |
| 3210212 | 5/1983 | Fed. Rep. of Germany . | |
| 8506246 | 4/1986 | Fed. Rep. of Germany . | |
| 3626762 | 2/1988 | Fed. Rep. of Germany . | |
| 3712707 | 11/1988 | Fed. Rep. of Germany . | |
| 3324676 | 10/1989 | Fed. Rep. of Germany . | |
| 762292 | 4/1934 | France . | |
| 480654 | 2/1938 | United Kingdom . | |

OTHER PUBLICATIONS

"FEIN Elektro-Spezial-Schneider", C. & E. Fein, GmbH & Co., 4 pages.

*Primary Examiner*—Frank T. Yost
*Assistant Examiner*—John M. Husar
*Attorney, Agent, or Firm*—Barry R. Lipsitz

[57] ABSTRACT

To so improve a paring knife for paring off the remainders of a bead of adhesive with which a motor vehicle pane was fixed on a motor vehicle body, comprising an attachment part for fixing the paring knife to a pivotally oscillating drive and a cutting part having a cutting edge and extending in a longitudinal direction away from the attachment part, that the paring efficiency to be achieved with it is better, it is proposed that the cutting part comprise as first cutting edge a side edge arranged on a side of the cutting part and extending in the longitudinal direction in a first cutting surface, and that the cutting part comprise at a front end opposite the attachment part a supporting surface extending substantially perpendicularly to the first cutting surface at the front end and transversely to the longitudinal direction and protruding in the longitudinal direction beyond the cutting part.

21 Claims, 2 Drawing Sheets

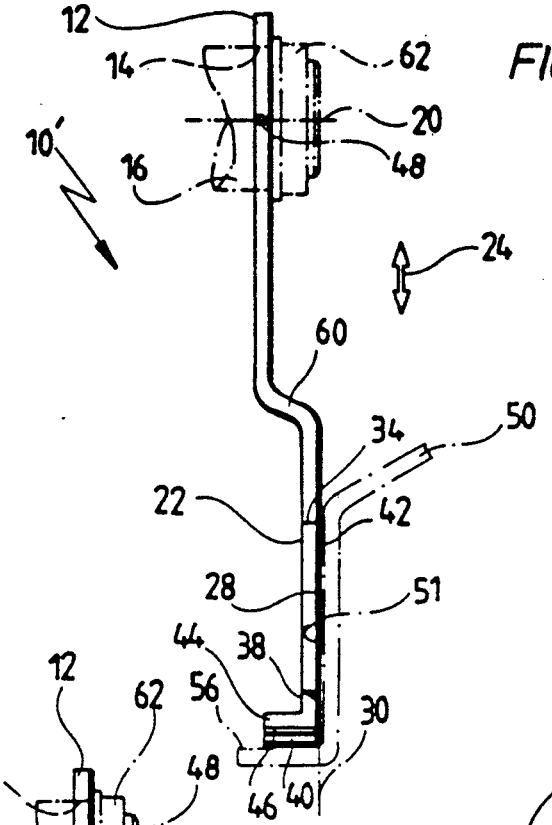
FIG.4
FIG.5
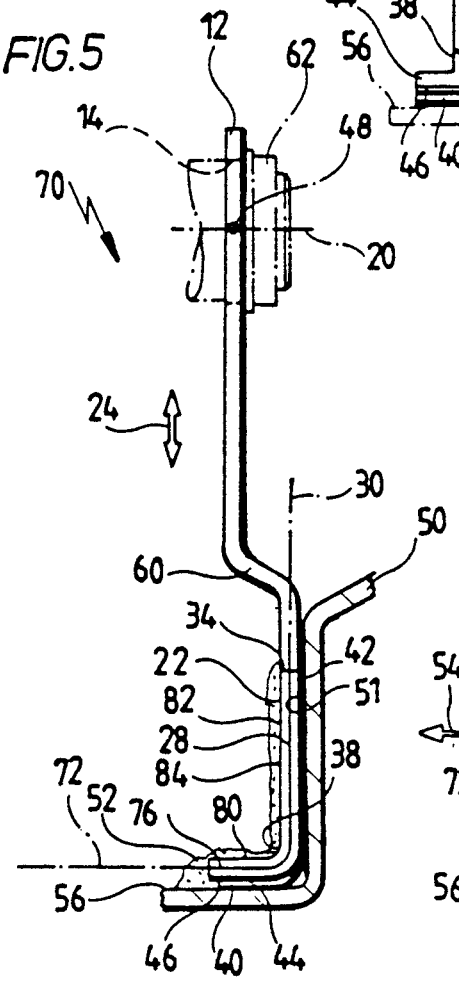
FIG.6
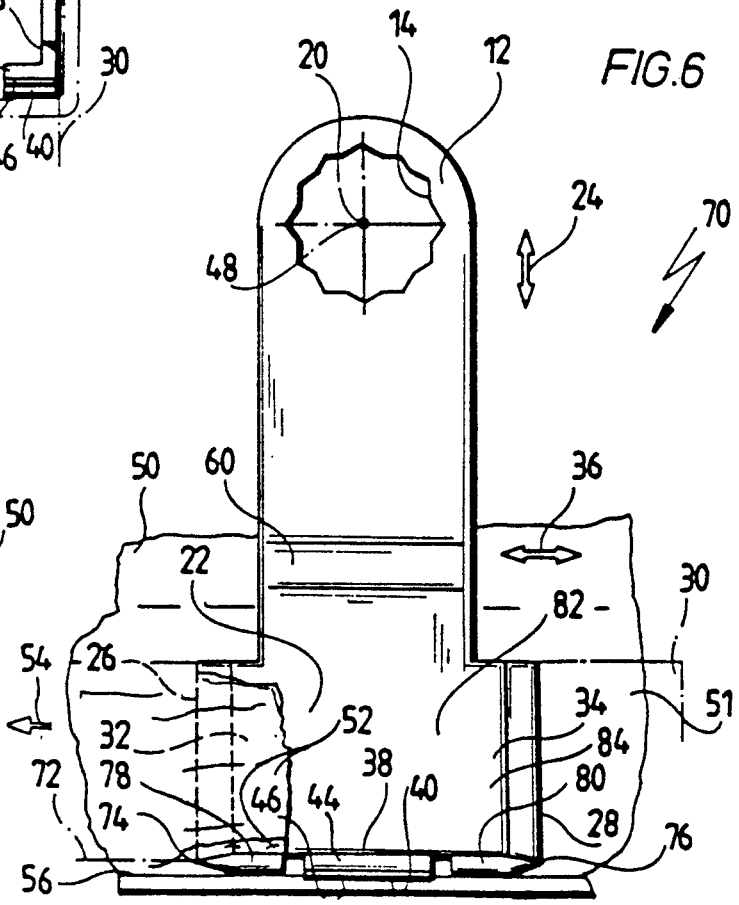
FIG.7
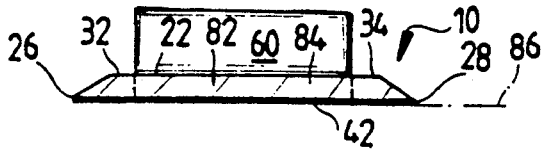

PARING KNIFE

BACKGROUND OF THE INVENTION

The invention relates to a paring knife for paring off the remainders of a bead of adhesive with which a motor vehicle pane was fixed on a motor vehicle body, comprising an attachment part for fixing the paring knife to a pivotally oscillating drive and a cutting part having a cutting edge and extending in a longitudinal direction away from the attachment part.

Such paring knives are known from the prior art. In these paring knives, the cutting edge extends transversely to the longitudinal direction of the attachment part and is, therefore, also oscillatingly moved by the pivotally oscillating drive transversely to the direction in which the bead of adhesive extends in order to pare off the remainders thereof.

With such a paring knife, the paring efficiency has not proven optimal.

SUMMARY OF THE INVENTION

The object underlying the invention is, therefore, to so improve a paring knife of the generic kind that the paring efficiency to be achieved with it is better.

This object is accomplished in accordance with the invention with a paring knife of the kind described at the beginning by the cutting part comprising as first cutting edge a side edge arranged on a side of the cutting part and extending in the longitudinal direction in a first cutting surface, and by the cutting part comprising at a front end opposite the attachment part a supporting surface extending substantially perpendicularly to the first cutting surface at the front end and transversely to the longitudinal direction and protruding in the longitudinal direction beyond the cutting part.

The advantage of the inventive solution is to be seen in the fact that in the inventive paring knife the cutting edges extend in the longitudinal direction of the cutting part and, in addition, a supporting surface provided at the front end of the cutting part protrudes beyond the latter, thereby making it possible for the paring knife to be supported on the flange wall during movement along a conventional flange of a window frame so as to avoid damage to the flange wall by the end of the paring knife oscillating back and forth parallel to the flange wall.

Handling of the paring knife is particularly convenient when the cutting part comprises as first cutting edges two side edges arranged on opposite sides of the cutting part and extending in the longitudinal direction in the first cutting surface.

In a particularly preferred embodiment of the inventive paring knife for preventing any damage to the flange wall, provision is made for the supporting surface to be the surface of an elastic layer.

To enable the inventive paring knife to be placed particularly well against a flange wall, provision is made for the supporting surface to extend above an underside of the cutting part, i.e., for example, to rise from this underside so the cutting part can be placed with an underside against the flange base and the supporting surface can then be supported by the flange wall.

In an embodiment which is particularly simple from a structural viewpoint, provision is made for the supporting surface to be carried by a stop element connected to the cutting part.

In particular for manufacturing reasons, it is particularly expedient for the stop element to be integrally formed on the cutting part as this eliminates costly manufacturing steps for attaching the stop element to the cutting part.

In the simplest case, provision is made for the stop element to be an angular portion of the cutting part.

Particularly convenient handling of the inventive paring knife is achieved when the supporting surface is arranged at approximately the middle of the cutting part in the transverse direction as the inventive paring knife can then be effectively supported on the flange wall during its oscillating motions.

Regarding the structure of the elastic layer, it has proven particularly advantageous for the elastic layer to be formed from whirl sintered elastic material.

It is, however, also expedient to use other materials such as, for example, plastic and rubber materials, all of which should preferably be softer than the material from which the motor vehicle body is made.

Regarding the design of the cutting edges, it has proven expedient for the first cutting edges to extend parallel to each other.

In addition, it has proven expedient for the first cutting edges and the underside of the cutting part extending between these to be flush with one another in the transverse direction. In this way, the inventive paring knife can be placed with its underside on a flange base and with the cutting edges resting on the flange base reliably removes all of the remainders of the bead of adhesive therefrom.

In a further preferred embodiment, provision is made for the cutting part to comprise at the front end a second cutting edge extending perpendicularly to the first cutting edge and in the same direction as the supporting surface in a second cutting surface substantially perpendicular to the first cutting surface. It is preferable for a second cutting edge to be provided on both sides of the cutting part.

This embodiment makes it possible for the remainders of the bead of adhesive present on the flange wall of a window flange to be removed at one go together with the remainders of the bead of adhesive adhering to the flange base.

It is most expedient for the second cutting edges to be arranged on both sides of the supporting surface so the supporting surface lies half way between these.

Regarding the way in which these second cutting edges are to be arranged on the cutting part, it is advantageous for the second cutting edge to be arranged on a wing of the cutting part protruding from the first cutting surface.

In connection with the stop element likewise held on the cutting part, it is expedient for the wings carrying the second cutting edges to enclose the stop element carrying the supporting surface between them.

From a manufacturing viewpoint, it is simplest for the wing to be integrally connected to a cutter plate of the cutting part extending in the first cutting surface.

To avoid damage to the flange wall in spite of the second cutting edges extending parallel to the supporting surface, provision is made in a particularly expedient embodiment for the second cutting surface to be arranged on a side of the supporting surface facing the attachment part at a distance from the supporting surface so the supporting surface still protrudes in the longitudinal direction beyond the cutting part.

Regarding the connection between the cutting part and the attachment part, the simplest solution is for the cutting part and the attachment part to be flush with each other and preferably even integral. A particularly preferred embodiment of the inventive paring knife is, however, designed such that an intermediate part oriented transversely to the first cutting surface is provided between the cutting part and the attachment part. With this intermediate part, an offset is achieved between the attachment part and the cutting part and so the cutting part is easier to guide.

In particular, to avoid collisions with the motor vehicle body, it is most expedient for the intermediate part to be bent at an angle in the same direction as the supporting surface in relation to the cutting part so the attachment part and the supporting surface are arranged on the same side of the first cutting surface.

In a particularly practical solution, provision is made for the intermediate part to be bent at an angle in relation to the attachment part in the direction opposite to that in relation to the cutting part so, as a whole, this embodiment of the inventive paring knife exhibits a bent, Z-like shape.

BRIEF DESCRIPTION OF THE DRAWINGS

Further features and advantages of the invention are set forth in the following description and the appended drawings of several embodiments. The drawings show:

FIG. 4 a side view similar to FIG. 2 through a variant of the first embodiment;

FIG. 5 a side view similar to FIG. 2 through a second embodiment;

FIG. 6 a plan view similar to FIG. 3 of the second embodiment; and FIG. 7 a section in the transverse direction 36 through a variant of the second embodiment illustrated in FIGS. 5 and 6.

Figure 1:
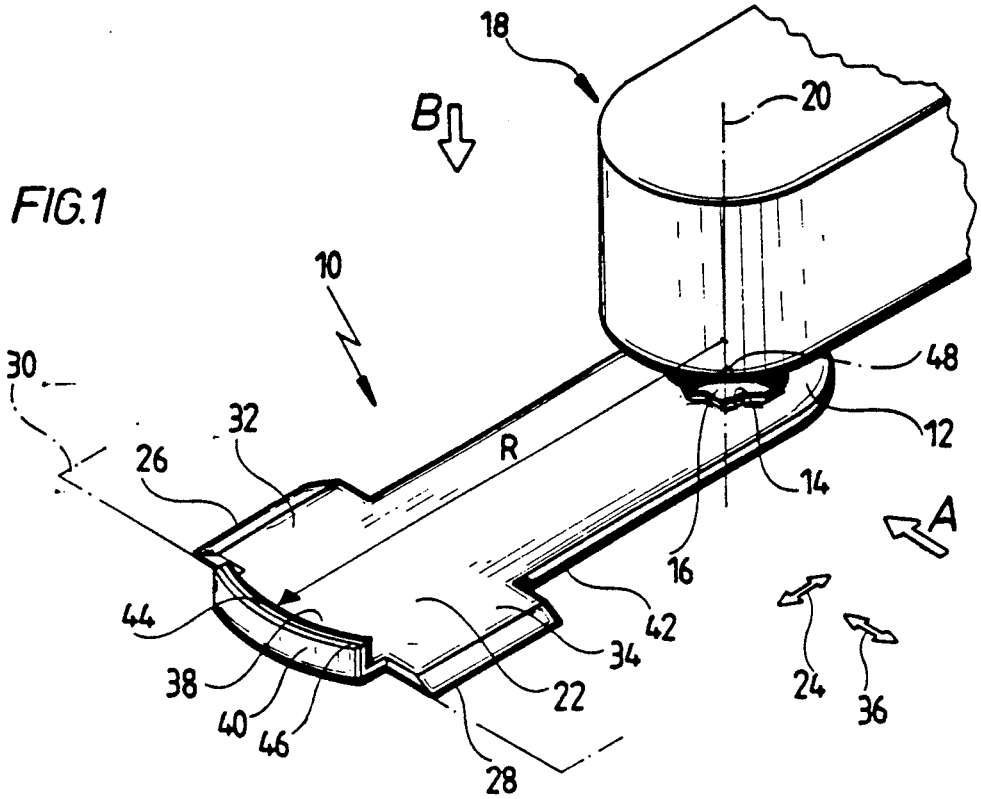
FIG. 1 a perspective view of a first embodiment of the inventive paring knife, held on a pivot drive.

A first embodiment, designated in its entirety 10, of an inventive paring knife comprises an attachment part 12 containing in the middle thereof an attachment opening 14 with which the attachment part 12 is attachable to a drive shaft 16 of a pivot drive 18. The pivot drive 18 allows the drive shaft 16 to oscillate about its axis 20 with pivot angles of less than ±10 degrees and between 10,000 and 30,000 strokes/min. and so the entire paring knife 10 is also oscillatingly pivotable about the axis 20 with the same angles.

A cutting part 22 is held on the attachment part 12. The cutting part 22 extends in a longitudinal direction 24 oriented away from the attachment part 12. The opposed longitudinal side edges of the cutting part 22 are designed as first cutting edges 26 and 28 which extend in a first cutting plane 30 parallel to the longitudinal direction 24 in this longitudinal direction 24 and thereby run approximately parallel to a direction extending radially in relation to the axis 20 and so during the pivotally oscillating motion about the axis 20, the cutting edges 26 and 28 carry out a thrusting motion perpendicularly to the radial direction.

The attachment part 12 which is formed from flat material is preferably aligned parallel to the first cutting plane 30.

The first cutting edges 26 and 28 preferably extend parallel to each other and are arranged at side regions 32 and 34 with which the cutting part 22 extends beyond the attachment part 12 in a transverse direction 36 extending perpendicular to the longitudinal direction 24.

Figure 2:
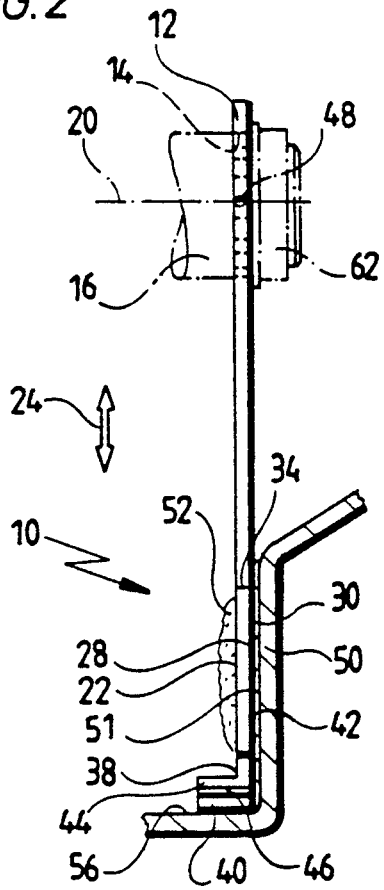
FIG. 2 a side view, in the direction of arrow A in FIG. 1.

As may be seen, in particular from FIGS. 1 and 2, a supporting surface 40 is provided at a front end 38 of the cutting part 22 opposite the attachment part 12. The supporting surface 40 extends perpendicularly to the cutting plane 30 and in the transverse direction 36. It is preferable for the supporting surface 40 to extend from an underside 42 of the paring knife 10 in a direction perpendicular to the cutting plane 30 without protruding beyond the underside 42.

Figure 3:
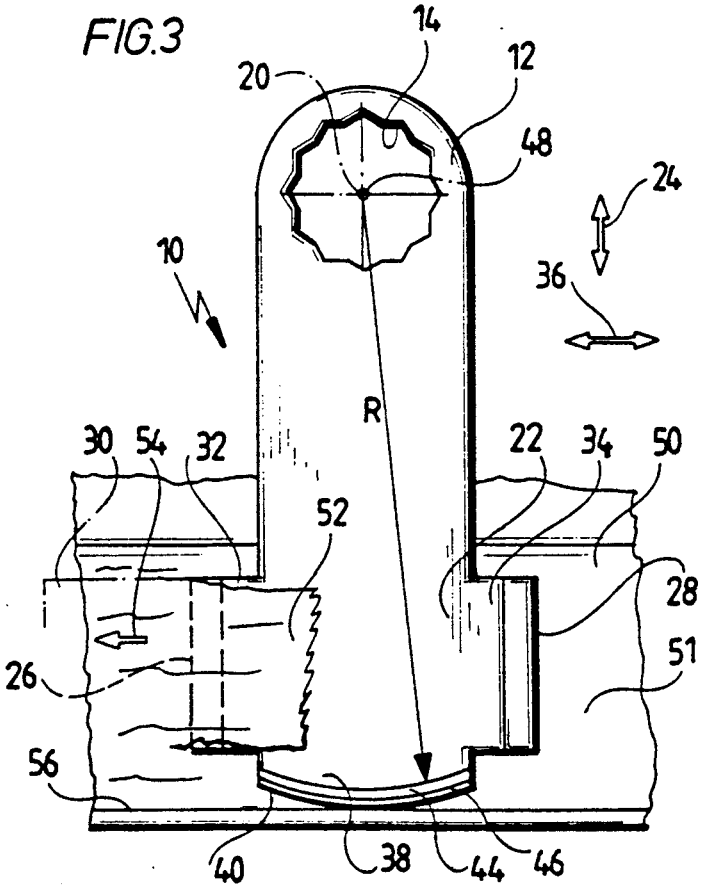
FIG. 3 a plan view in the direction of arrow B in FIG. 1.

The supporting surface 40 is preferably carried by a web 44 which, as may be seen particularly clearly in FIG. 3, is coated with an elastic layer 46, preferably a whirl sintered layer, the surface of which forms the supporting surface 40.

In accordance with the invention, the web 44 is integrally formed as angular, bent portion on the cutting part 22. The cutting part 22 and the attachment part 12 are also preferably of integral configuration.

As may be seen, in particular in FIG. 3, in the first embodiment 10 of the inventive paring knife, the supporting surface 40 is of curved configuration, more particularly, with a radius of curvature R which corresponds to a distance R from an attachment center point 48 located at the center of the attachment opening 14 and penetrated by the axis 20.

This supporting surface 40 ensures, as may be seen, in particular from FIGS. 2 and 3, that a remainder 52 of a bead of adhesive left on a flange base 51 of a window flange 50 of a motor vehicle body after removal of the motor vehicle pane can be pared off in a simple way by the inventive paring knife 10 being oscillatingly guidable with a first cutting edge 26 extending transversely to a longitudinal direction 54 of the remainder 52 of the bead of adhesive in this longitudinal direction 54 along the window flange 50 and being able to be supported with the supporting surface 40 on a flange wall 56 of the window flange 50.

In a preferred variant 10' of the first embodiment of the inventive paring knife, insofar as the parts are identical with those of the first embodiment, these bear the same reference numerals and, therefore, reference is to be had in this connection to the statements on the first embodiment.

In contrast with the first embodiment, an intermediate part 60 is provided between the attachment part 12 and the cutting part 22. The intermediate part 60 is bent at an angle in relation to the cutting part 22 in the direction in which the supporting surface 40 extends and in relation to the attachment part 12 in the opposite direction so, as a whole, the variant 10' of the inventive paring knife is bent at angles and hence an attachment screw 62 for attaching the paring knife 10' to the drive shaft 16 cannot come into contact with the window frame 50.

In a second embodiment, designated in its entirety 70, of an inventive paring knife, illustrated in FIGS. 5 and 6, those parts identical with those of the first embodiment bear the same reference numerals and, therefore, for a description of these, reference is to be had to the statements on the first embodiment.

In contrast with the first embodiment, the cutting part 22 comprises in addition to the first longitudinal side edges 26 and 28 extending in the first cutting plane 30 second cutting edges 74 and 76 extending in a second cutting plane 72. The second cutting plane 72 extends parallel to the transverse direction 36 and perpendicularly to the first cutting plane 30. The second cutting edges 74 and 76 extend in continuation of the first cutting edges 26 and 28 from the latter in the same direction as the supporting surface 40 in the second cutting plane 72.

The second cutting edges 74 and 76 are carried by two wings 78 and 80 which extend perpendicularly to a cutter plate 82 extending parallel to the first cutting plane 30 and carrying the first cutting edges 26 and 28. The wings 78 and 80 are preferably in the form of angular portions formed integrally on the cutter plate 82.

In the second embodiment 70, the supporting surface 40 is carried by the web 44 which lies between the wings 78 and 80 and is likewise formed as an integral angular portion on the cutter plate 82. The web 44 and the wings 78 and 80 extend in the same direction away from the first cutting plane 30.

As may be seen from FIGS. 5 and 6, the second cutting plane 72 is arranged at a slight distance from the supporting surface 40 on a side thereof facing the attachment part 12 so the supporting surface 40 extends in the longitudinal direction 24 beyond the entire cutting part 22 and hence allows a supporting of the paring knife 70 on the flange wall 56 without the cutting part 22 striking, in particular with the second cutting edges 74 and 76, the flange wall 56 and thereby causing damage to the window flange.

At the same time, however, the second side edges 74 and 76 allow removal of remainders of the bead of adhesive present on the flange wall 56, for which purpose the paring knife 70 according to the second embodiment can be simultaneously supported on the flange wall 56 without damaging it.

In the second embodiment, as may be seen from FIG. 5, the first cutting edges 26 and 28 are preferably placed such that they lie approximately half way between the underside 42 and an upper surface 84 of the cutting part 22, i.e., the paring knife according to the second embodiment 70 is ground on both sides thereof. The same applies to the second cutting edges 74 and 76, as may be seen from FIG. 6.

In contrast with this, as shown in FIG. 7, in a variant of the second embodiment 70', the first cutting edges 26 and 28 are placed in a plane 86 in which the underside 42 also lies and so when this variant 70' of the second embodiment is placed on the flange base 51 of the window flange, all of the remainders of the bead of adhesive can be completely pared off.

The present disclosure relates to the subject matter disclosed in German application No. P 39 29 852.3 of Aug. 15, 1989, the entire specification of which is incorporated herein by reference.

What is claimed is:

1. A paring knife for paring off the remainder of a bead of adhesive with which a motor vehicle pane was fixed on a motor vehicle body comprising:

an attachment part for fixing said paring knife on a pivotally oscillating drive;

a cutting part extending in a longitudinal direction away from said attachment part, said cutting part having a first cutting edge arranged on a side of said cutting part as a side edge extending in said longitudinal direction in a first cutting surface; and a supporting surface in a front end of said cutting part opposite said attachment part, for supporting said paring knife on a flange wall of said motor vehicle body during a paring off operation and functioning to prevent damage to said flange wall while in engagement therewith when said paring knife is oscillating back and forth parallel to said flange wall;

said supporting surface extending substantially perpendicularly to said first cutting surface at said front end and transversely to said longitudinal direction and protruding in said longitudinal direction beyond said cutting part.

2. A paring knife as defined in claim 1, characterized in that said cutting part comprises as first cutting edges two side edges arranged on opposite sides of said cutting part and extending in said longitudinal direction in said first cutting surface.

3. A paring knife as defined in claim 1, characterized in that said supporting surface is the surface of an elastic layer.

4. A paring knife as defined in claim 1, characterized in that said supporting surface extends above an underside of said cutting part.

5. A paring knife as defined in claim 1, characterized in that said supporting surface is carried by a stop element connected to said cutting part.

6. A paring knife as defined in claim 5, characterized in that said stop element is integrally formed on said cutting part.

7. A paring knife as defined in claim 6, characterized in that said stop element is an angular portion of said cutting part.

8. A paring knife as defined in claim 1, characterized in that said supporting surface is arranged at approximately the middle of said cutting part in said transverse direction.

9. A paring knife as defined in claim 3, characterized in that said elastic layer is formed from whirl sintered elastic material.

10. A paring knife as defined in claim 2, characterized in that said first cutting edges extend parallel to each other.

11. A paring knife as defined in claim 4, characterized in that said first cutting edges and said underside of said cutting part extending between these are flush with one another in said transverse direction.

12. A paring knife as defined in claim 1, characterized in that said cutting part comprises at said front end a second cutting edge extending perpendicularly to said first cutting edge and in the same direction as said supporting surface in a second cutting surface perpendicular to said first cutting surface.

13. A paring knife as defined in claim 12, characterized in that one second cutting edge is provided on either side of said cutting part.

14. A paring knife as defined in claim 13, characterized in that said second cutting edges are arranged on either side of said supporting surface.

15. A paring knife as defined in claim 12, characterized in that said second cutting edge is arranged on a wing of said cutting part protruding from said first cutting surface.

16. A paring knife as defined in claim 15, characterized in that a pair of wings carry second cutting edges and include said stop element carrying said supporting surface between them.

17. A paring knife as defined in claim 15, characterized in that said wing is integrally connected to a cutter plate of said cutting part extending in said first cutting surface.

18. A paring knife as defined in claim 12, characterized in that said second cutting surface is arranged on a side of said supporting surface facing said attachment part at a distance from said supporting surface.

19. A paring knife as defined in claim 1, characterized in that an intermediate part oriented transversely to said first cutting surface is provided between said cutting part and said attachment part.

20. A paring knife as defined in claim 19, characterized in that said intermediate part is bent at an angle in the same direction as said supporting surface in relation to said cutting part.

21. A paring knife as defined in claim 19, characterized in that said intermediate part is bent at an angle in relation to said attachment part in the direction opposite to that in relation to said cutting part.

* * * * *